US006862997B2

(12) United States Patent
Bussink

(10) Patent No.: US 6,862,997 B2
(45) Date of Patent: Mar. 8, 2005

(54) AMUSEMENT DEVICE AND METHOD FOR USING AN AMUSEMENT DEVICE

(75) Inventor: Ronald Alexander Bussink, Meistersrüte (CH)

(73) Assignee: Ronald Bussink Amusement Design GmbH (DE)

( * ) Notice: Subject to any disclaimer, the term of this patent is extended or adjusted under 35 U.S.C. 154(b) by 0 days.

(21) Appl. No.: 10/379,424

(22) Filed: Mar. 4, 2003

(65) Prior Publication Data

US 2003/0217667 A1 Nov. 27, 2003

(30) Foreign Application Priority Data

May 21, 2002 (EP) ..... 02076962

(51) Int. Cl.[7] ..... A63G 1/00
(52) U.S. Cl. ..... 104/79; 104/75
(58) Field of Search ..... 104/79, 53, 80, 104/67, 74, 75, 76; 472/30, 32, 35, 36, 37, 39, 106

(56) References Cited

U.S. PATENT DOCUMENTS

| | | | | |
|---|---|---|---|---|
| 791,315 A | * | 5/1905 | Bragg | 104/79 |
| 1,351,658 A | | 8/1920 | Johnson | |
| 1,515,533 A | * | 11/1924 | Dellmont | 104/55 |
| 1,546,375 A | * | 7/1925 | Geiser | 104/79 |
| 1,730,265 A | * | 10/1929 | Bulmer | 104/79 |
| 1,799,409 A | | 4/1931 | Custer | |
| 2,567,438 A | * | 9/1951 | McBride | 104/55 |
| 4,973,042 A | * | 11/1990 | Klopf et al. | 472/2 |

FOREIGN PATENT DOCUMENTS

| | | |
|---|---|---|
| DE | 198 09 641 A | 9/1999 |
| GB | 2 278 291 A | 11/1994 |

* cited by examiner

*Primary Examiner*—Mark T. Le
(74) *Attorney, Agent, or Firm*—Webb Ziesenheim Logsdon Orkin & Hanson, P.C.

(57) ABSTRACT

This invention relates to an amusement device and method for using an amusement device. The amusement device comprises a guideway being pivotable around a swivel axis, the axis being transverse to the guideway, and a bearing frame carrying, at a distance from the ground, the guideway wherein a passenger carrier is mounted to said guideway and in that the passenger carrier is movable along said guideway. Preferably the guideway is rotatable around an essentially vertical rotation axis.

19 Claims, 3 Drawing Sheets

AMUSEMENT DEVICE AND METHOD FOR USING AN AMUSEMENT DEVICE

BACKGROUND OF THE INVENTION

1. Field of the Invention

The present invention relates to an amusement device comprising:

a guideway being pivotable around a swivel axis, the axis being essentially transverse to the guideway a bearing frame carrying, at a distance from the ground, the guideway.

2. Brief Description of the Related Art

An amusement device of that type is known from the prior art. In recreation areas for children, seesaws are commonly known. Such seesaws comprise a bearing frame that is placed on the ground, and a swivel axis that is mounted on top of the bearing frame. A beam or girder is connected to the swivel axis, so that the beam or girder is pivotable around the swivel axis, transverse to the swivel axis. On both outer ends of the beam or girder, children of approximately equal weight can play on a seesaw.

It is a disadvantage of seesaws known from the prior art, that a movement in only one dimension is possible. The only movement that can be made is pivoting around the swivel axis, resulting in the children being lifted off the ground for a short period of time. It is further a disadvantage that a child should be placed on both end points of the guideway, in order to ensure the right counterweight for each child.

It is an object of the present invention to provide an amusement device that has the possibility to move in more than one direction. It is further an object of the present invention to provide an amusement device in which it is not necessary for the passengers to use their own strength to start a movement. It is a further object of the present invention to provide an amusement device that achieves spectacular movement effects for the passengers.

SUMMARY OF THE INVENTION

The objects of the present invention are achieved in that a passenger carrier is mounted to said guideway and that the passenger carrier is movable along said guideway. A passenger carrier is mounted to the guideway hi use, the guideway pivots around the swivel axis, while the passenger carrier moves along the guideway. From a standstill, the guideway can be pivoted around the swivel axis until one first end point of the guideway reaches its highest point. The passenger carrier that is up to then kept fixed to the first end point of the guideway reaches the highest point too. After releasing the passenger carrier from this highest position, the passenger carrier can move along the guideway by gravitation force only. This can result in a kind of free fall experience for passengers in the carrier. No additional drive is necessary to move the passenger carrier. Nevertheless it is possible to mount an additional drive to the passenger carrier and/or the guideway to enhance the acceleration of the passenger carrier. While the passenger carrier is moving downward towards the swivel axis, one can pivot the guideway around the pivot point to lower said first end point. By this one can allow the passengers to experience a weightlessness. Other movements, for example pivoting the guideway in another direction, are also possible.

The swivel axis around which the guideway pivots can be mounted to meet an angle with a maximum of approximately 30 degrees in relation to the axis transverse to the guideway. This is still considered to be essentially transverse to the guideway.

The passenger carrier starts moving from a first end of the guideway to a second end of the guideway. While moving the passenger carrier from the first end of the guideway in the direction of the swivel axis, it is possible for the guideway to pivot around the swivel axis, Preferably the guideway has at least partly pivoted around the swivel axis when the passenger carrier reaches the swivel axis, so that the passenger carrier moves up to the second end of the guideway. Moving up while moving towards the second end of the guideway does not make it necessary to mount a braking system to the amusement device, as the gravitation force slows the passenger carrier down while moving upwards.

The amusement device can further be characterised in that said guideway is rotatable around an essentially vertical central rotation axis. In order to intensify the feeling of speed and rotation in the amusement device, the guideway is rotatable around the vertical rotation axis. A three-dimensional movement is then achieved. By varying the rotational speed around the essentially vertical central rotation axis, the movement experienced by the passenger is made unpredictable.

The amusement device can further be characterised in that said guideway comprises at least one curve in the longitudinal direction of said guideway. A guideway with a curve simplifies the loading and unloading process of the passenger carrier. Preferably the curve is approximately 45 degrees. Whenever the passenger carrier is located in the first end of the guideway, it is being preferred that the passengers can board and unboard the passenger carrier relatively effortless. It is therefore required for the passenger carrier to be essentially parallel to the underground when loading and unloading passengers.

In a further embodiment, the present invention is characterised in that the guideway is convex-concave shaped, the convex side facing the ground. The guideway being convex-concave shaped allows the passengers to experience G-forces when moving into the convex-concave shaped part of the guideway. The guideway can also be formed as the crossection of a barrel, thus having a curve along the entire length of the guideway, The guideway can comprise an arc of a circle, or any other parabolic shape.

Furthermore, a curve in the guideway intensifies the feeling of speed and movement for the passengers when making a ride in the amusement device. This is due to a sudden change in direction of the passenger carrier while moving. G-forces caused by the sudden change in direction work on the passengers and provide said feeling.

Furthermore, a curve in the guideway provides a more compact construction of the amusement device. The passenger carrier is able to reach greater hights whilst having the same horizontal dimensions, compared to an amusement device having a straight guideway. This enables the amusement device to be placed on a relatively small surface area during a fun fair or the like. Costs for renting a surface area for a stay on a fun fair are therefore not raised unnecessary.

The amusement device according to the invention can have opposing end parts, the end parts extending about straight under an angle of about 90 degrees with respect to each other. This allows the passenger carrier to reach the highest possible point and intensifies the feeling of speed for the passengers. When releasing the carrier from the highest possible point, a free fall movement can be obtained.

The amusement device according to the present invention can firer be characterised in that said guideway comprises a guiding cable for guiding the passenger carrier along the guideway, the guiding cable being connected to the guideway and the passenger carrier. This guiding cable provides a means for propelling the passenger carrier in either the foreward or backward direction, especially, but not limited to, in a case that the passenger carrier gets stuck in-between both end points of the guideway.

In a further embodiment of the present invention the amusement device is characterised in that the passenger carrier is a passenger gondola comprising seats, the gondola being suspended from and movable along said guideway. A suspended gondola provides a seating for the passengers in which the legs of the passengers can move freely. Furthermore the suspended gondola provides an unobstructed view towards the underground while the amusement device is in use. This intensifies for the passengers the scary feeling of speed and height.

In a further embodiment of the present invention the amusement device is characterised in that the passenger carrier is a cart comprising seats, the cart being mounted onto and movable along the guideway. In a cart mounted onto the guideway, the passenger is well protected from outside influences The passengers are protected by the skin and chassis of the cart.

Furthermore, the amusement device can be characterised in that the device comprises a braking device being mounted to the guideway and/or the passenger carrier. Preferably this braking device comprises a magnetic braking system. The braking system, especially the magnetic braking system, can be mounted to the guideway in order to reduce the weight of the passenger carrier itself. The braking system is used to stop the passenger carrier in a case of need.

In a further embodiment the amusement device of the present invention is characterised in that the device is mounted on a mobile platform, preferably a platform comprising wheels. An amusement device mounted on a mobile platform is movable from one fun fair to another. The amusement device can be placed on a chassis or undercarriage of a truck, thus making it possible for the amusement device to be moved over normal roads from one place to another. The chassis or undercarriage can be provided with actuating means to adjust the chassis or undercarriage of the amusement device to be placed on an uneven terrain.

In a further embodiment of the present invention, the amusement device is characterised in that at least a part of the passenger carrier is rotatably mounted to the guideway. A rotating movement of the passenger carrier with respect to the guideway results in a further spectacular movement effect for the passengers in the carrier. Furthermore, variations in movements can be obtained.

Furthermore the invention relates to a method for use of the amusement device of the present invention. The method according to the invention is characterised in that the passenger carrier moves along a part of the guideway in the direction of the swivel axis while the swivel axis is located lower than the passenger carrier. Furthermore the method is characterised in that the movement of the passenger carrier is an acceleration under influence of gravity. The passenger carrier moves along said part of the guideway freely, for example driven by the force of gravitaty and gains speed while moving from the first end point in the direction of the swivel axis.

The method can further be characterised in that said part of the guideway swivels simultaneously with the moving of the passenger carrier around the swivel axis in a downward direction, the swivel movement preferably being about a free fall. The movement that is being obtained for the passenger carrier is a movement along the guideway and a free fall movement in a downward direction. This intensifies the feeling of weightlessness for the passengers.

Furthermore the invention relates to a method for use of the amusement device of the present invention characterised in that the passenger carrier moves along apart of the guideway in the direction away from the swivel axis while the swivel axis is located lower than the passenger carrier. The passenger carrier is then moving upwards, thus losing speed. Furthermore the method can be characterised in that the movement of the passenger carrier is a decelerating movement under influence of gravity, It is therefore not necessary to use a braking system to stop the passenger carrier near or in its highest point.

Furthermore the method of the invention can be characterised in that said part of the guideway is swivelled, simultaneously with the moving of the passenger carrier, around the swivel axis in an upward direction.

In a further embodiment, the method according to the present invention is characterised in that the guideway rotates around an essentially vertical central rotation axis. When rotating around a essentially vertical central rotation axis, an intensified feeling of speed as well as a complete unawareness of the direction in which the passenger is moving will occur to the passengers in the passenger carrier.

BRIEF DESCRIPTION OF THE DRAWINGS

The invention will be explained in detail with reference to the accompanying drawings, in which.

DETAILED DESCRIPTION OF THE PREFERRED EMBODIMENTS

Figure 1:
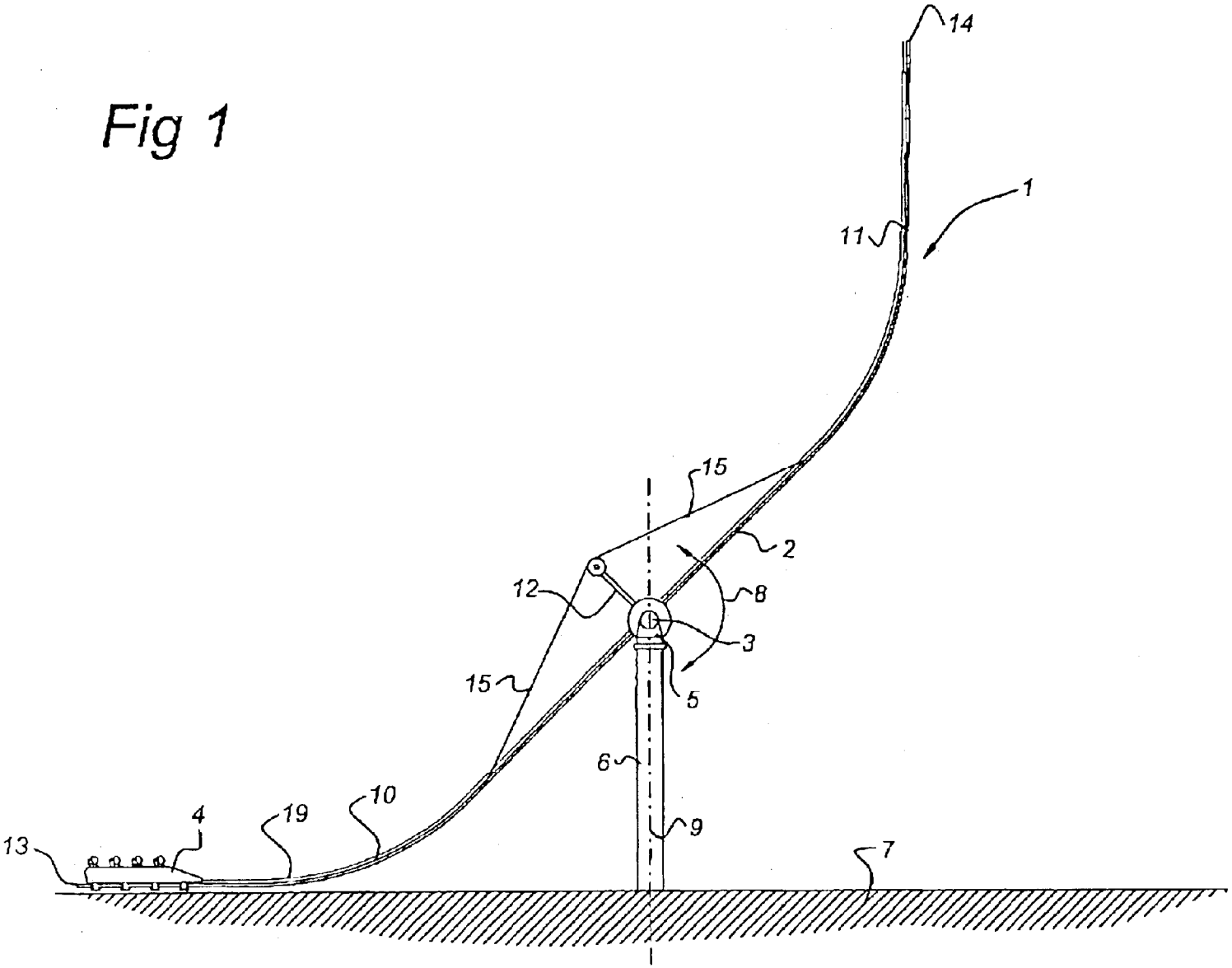
FIG. 1 shows a side view of an amusement device according to the present invention.

FIG. 1 shows a side view of an amusement device 1 according to the present invention, The amusement device 1 comprises a guideway 2 being pivotable around a swivel axis 3 and a passenger carrier 4 mounted to that guideway. The swivel axis 3 is transverse to the guideway 2. The swivel axis is placed in a bearing frame 5, placed at a distance from the ground, This bearing frame 5 carries the guideway 2 and the swivel axis 3. The bearing frame 5 is placed on a support column 6 to obtain the needed height above the ground 7.

The guideway 2 of the amusement device 1 is pivotable around the swivel axis 3 over a maximum of 90 degrees. The direction in which the guideway 2 can pivot is indicated by an arrow 8. The guideway 2 pivots back and forth over an angle of approximately 90 degrees.

The bearing frame 5 comprising the swivel axis 3 and the guideway 2 are rotatable around an essentially vertical axis of rotation 9. In FIG. 1 this axis of rotation is formed by the axis of the support column 6.

In use, the guideway 2 pivots around the swivel axis 3 while the passenger carrier 4 moves along the guideway 2. As shown in only FIG. 1, the passenger carrier 4 can move along a guiding cable 19 extending between the ends 13 and 14 of the guideway 2. After the passengers have boarded the passenger carrier 4, the guideway 2 is pivoted over an angle of approximately 90 degrees until tie passenger carrier 4 and die first end point 13 of the guideway 2 are in their respective highest positions above the ground. After releasing the passenger carrier 4 from its highest position, the carrier 4 starts moving along the guideway 2 towards the swivel axis 3 around which the guideway 2 pivots. At the same time the guideway 2 can pivot around the swivel axis 3, thereby moving the first end point 13 from its highest position towards a lower position. After the passenger carrier 4 has passed the swivel axis 3 and the guideway 2 has pivoted over an angle of at least 45 degrees, the passenger carrier 4 reaches a part of the guideway 2 that leads in upward direction. The passenger carrier 4 reaches its highest position near the second end point 14 of the guideway 2.

FIG. 1 shows a guideway 2 that comprises two curves 10, 11. The curve 10 simplifies the boarding and unboarding process of the passengers to and from the passenger carrier 4. The curve 10, 11 is therefore preferably 45 degrees, in order for the passenger carrier 4 to be essentially parallel to the underground 7. Passengers can board and unboard relatively effortless to and from the carrier 4 when it is placed parallel to the underground 7.

An additional beam 12 has been mounted perpendicular to the guideway 2. One end of the beam 12 is mounted to the guideway 2 while at the opposite end of the beam 12 cables or trangles 15 are mounted to ensure the stability and rigidity of the structure of the guideway 2.

Figure 2:
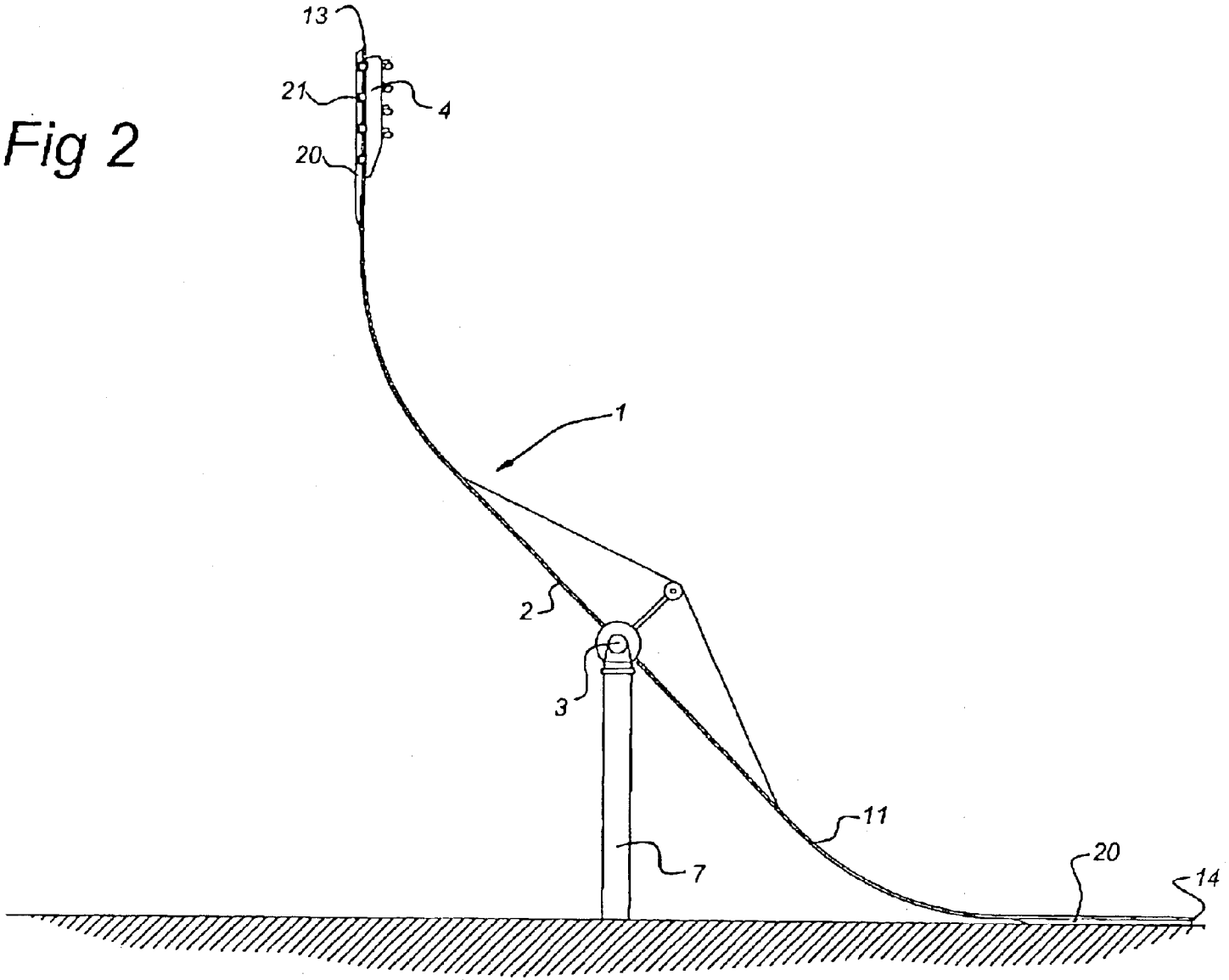
FIG. 2 shows a side view of the amusement device in the start position of a ride.

FIG. 2 shows a side view of the amusement device 1 in the start position of a ride. The passenger carrier 4 is in its highest position, near the first end point 13 of the guideway 2. The passenger carrier 4 is a cart comprising seats. The passengers are protected from outside influences by the skin and the chassis of the cart.

In the start position of a ride, the second end point 14 of the guideway 2 is parallel to the ground 7. The part of the guideway 2 between the swivel axis 3 and the second end point 14 is has also been provided with a curve 11. This enables the passenger carrier 4 still placed in the start position near the first end point 13 of the guideway 2 to reach up higher compared to a guideway 2 having a straight guideway 2 between the swivel axis 3 and the second end point 14.

The curves 10, 11 also provide an intensified feeling of speed and direction to the passenger. Due to both curves in the guideway 2, it is possible for the guideway 2 to pivot over a great angle, approximately 45 degrees.

As shown in only FIG. 2, the guideway 11 and passenger carrier 4 can optionally be provided with a magnetic braking system 20, 21. This braking system comprises a braking bar 20 mounted at the ends of the guideway 11 and braking feet 21 mounted at the passenger carrier. When the breaking feet move along the braking bar magnetic forces will brake the speed of the passenger carrier. By using electro magnets and switching means, this breaking system can be timed on and off, for example turned off for starting the ride from the position in FIG. 2 or for example turned on for braking the carrier 4 approaching an end 13, 12 of the guideway 11.

Figure 3:
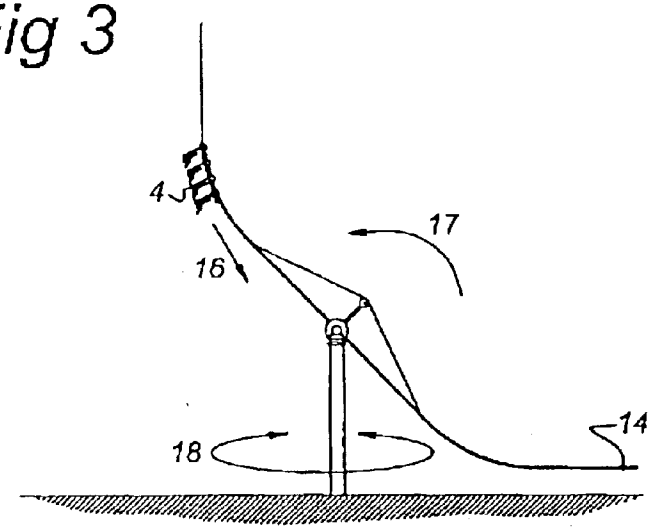
FIG. 3 shows a side view of tie amusement device while the passenger carrier is moving downward between the first end point and the swivel axis.

FIG. 3 shows a side view of the amusement device 1 while the passenger carrier 4, in this case the suspended passenger carrier 4, is moving along a part of the guideway 2 between the first end point 13 and the guideway in the direction of the arrow. This can be a free fall movement under influence of the force of gravity. FIG. 3 shows a suspended passenger carrier that is suspendedly connected to the guideway 2. The passenger carrier 4 is accelerating under the influence of gravity. Simultaneously with the moving of the passenger carrier 4, the guideway 2 swivels around the swivel axis 3 in a downward direction. This is indicated by the arrow 17. The movement can be a free fall movement, influenced by gravity. Furthermore the amusement device 1 rotates simultaneously around the central rotation axis 9, the possible directions of rotation indicated by the double arrow 18.

Figure 4:
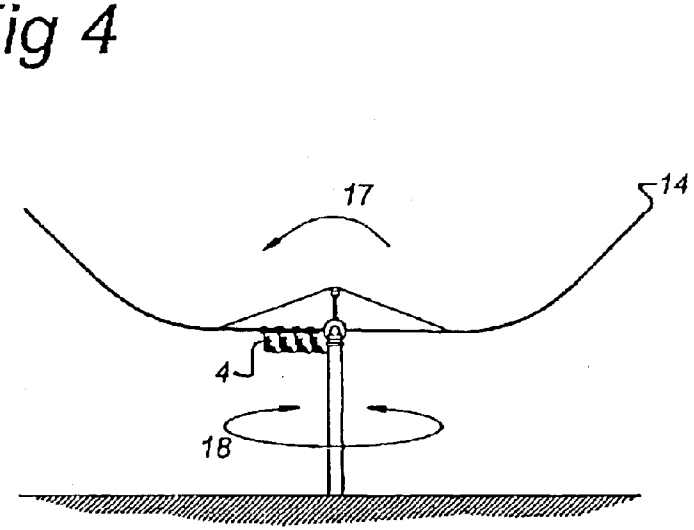
FIG. 4 shows a side view of the amusement device while the passenger carrier is moving near the swivel point.

FIG. 4 shows a side view of the amusement device while the passenger carrier 4 is near the swivel point 3. The passenger carrier 4 is moving in the direction of the arrow 16, while the guideway 2 is still swivelling in the direction of the arrow 17. Simultaneously the amusement device 1 rotates around the central rotation axis 9. The possible directions of rotation are indicated by the double arrow 18.

Figure 5:
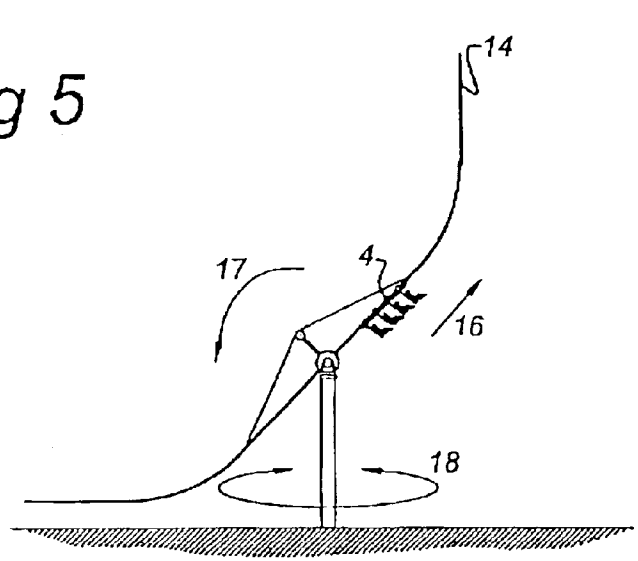
FIG. 5 shows a side view of the amusement device while the passenger carrier is moving upwards from the swivel axis to the second end point.

FIG. 5 shows a side view of the amusement device 1 while the passenger carrier 4, in this case a suspended passenger carrier, is moving between upward between the swivel axis 3 and the second end point 14. The direction in which the passenger carrier 4 is moving is indicated by the arrow 16. The passenger carrier 4 moves upwards. It is losing speed and decelerating because of the gravitation force that works on the carrier 4. Because of the upward movement of the passenger carrier 4, it is not necessary to use a braking system for the carrier 4 to stop.

The guideway pivoting around the swivel axis 3 in the direction indicated by the arrow 17. The amusement device 1 rotates around the central rotation axis 9. The possible directions of rotation are indicated by the double arrow 18.

Figure 6:
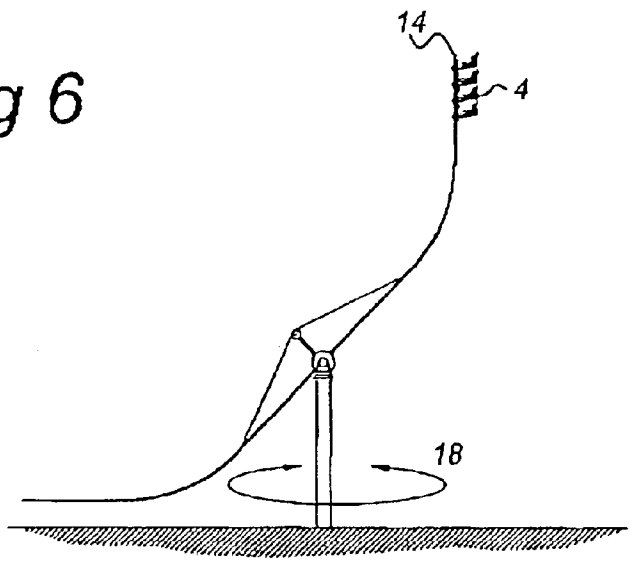
FIG. 6 shows a side view of the amusement device while the passenger carrier has reached its highest point near the second end point.

FIG. 6 shows a side view of the amusement device 1 while the passenger carrier 4 has reached its highest position near the second end point 14. The passenger carrier 4 is not moving, but is waiting to start the return journey to the first end point 13. In case the carrier has not reached the highest point near the second end point 14, the carrier 4 is driven into that point. The guideway 2 is pivoted into its highest position, the second end point 14 of the guideway 2 being essentially vertical It is still possible for the amusement device 1 to rotate around the central rotation axis 9. The possible directions of rotation are indicated by the double arrow 18.

After reaching the highest point as shown in FIG. 6, the passenger carrier 4 moves backwards in the direction of the first end point 13.

It is further possible for the passenger carrier to be rotatably mounted to the guideway. While experiencing the movements described above, the passengers of the carrier can experience a rotating movement of the carrier with respect to the guideway. This intensifies the feeling of speed and creates more variations in movements to be made.

What is claimed is:

1. An amusement device comprising:

a guideway pivotable around a swivel axis, the swivel axis intersecting the guideway about in the middle, and the guideway rotatable around a generally vertical central rotation axis;

a bearing frame carrying, at a distance from the ground, the guideway, the rotation axis and swivel axis intersecting on the bearing frame and substantially orthogonal to one another; and a passenger carrier mounted to said guideway, the passenger carrier being movable along said guideway.

2. The amusement device according to claim 1, wherein the guideway is pivotable around the swivel axis greater than about 90 degrees.

3. The amusement device according to claim 1, wherein the guideway is pivotable around the swivel axis greater than about 90 degrees between a first position and a second position, wherein in the first position a first opposing end part extends about horizontal and a second opposing end part extends about vertical, and wherein in the second position the second opposing end part extends about horizontal whilst the first opposing end part extends about vertical.

4. The amusement device according to claim 1, wherein said guideway comprises at least one curve in the longitudinal direction of said guideway.

5. The amusement device according to claim 1, wherein the guideway is convex-concave shaped, the convex side facing the ground.

6. The amusement device according to claim 5, wherein the guideway has opposing end parts forming an angle of about 90 degrees with each other.

7. The amusement device according to claim 1, wherein said guideway comprises a guiding cable for guiding the passenger carrier along the guideway, the guiding cable being connected to the guideway and the passenger carrier.

8. The amusement device according to claim 1, wherein the passenger carrier is a passenger gondola comprising seats, the gondola being suspended from and movable along said guideway.

9. The amusement device according to claim 1, wherein the passenger carrier is a cart comprising seats, the cart being mounted onto and movable along the guideway.

10. The amusement device according to claim 1, wherein the device comprises a braking device being mounted to the guideway and/or passenger carrier.

11. The amusement device according to claim 10, wherein the braking device comprises a magnetic braking system.

12. The amusement device according to claim 1, wherein at least a part of the passenger carrier is rotatably mounted to the guideway.

13. A method for moving passengers on an amusement device comprising the steps of:

a. providing an amusement device having a guideway pivotable around a swivel axis, the swivel axis intersecting the guideway about in the middle, and the guideway rotatable around a generally vertical central rotation axis, a bearing frame carrying, at a distance from the ground, the guideway, the rotation axis and swivel axis intersecting on the bearing frame and substantially orthogonal to one another, a passenger carrier mounted to said guideway, the passenger carrier being movable along said guideway;

b. placing passengers in the passenger carrier; and c. moving the passenger carrier along the guideway, the guideway simultaneously pivoting about the swivel axis and rotating about the rotation axis at the intersection on the bearing frame during the movement of the passenger carrier.

14. The method according to claim 13, wherein at least part of the movement of the passenger carrier is an acceleration under influence of gravity caused by the movement of the guideway.

15. The method according to claim 14, wherein the acceleration occurs during a downward movement of part of the guideway.

16. The method for use of the device according to claim 13, wherein the passenger carrier moves along a part of the guideway in the direction away from the swivel axis while the swivel axis is located lower than the passenger carrier.

17. The method according to claim 16, wherein at least part of the movement of the passenger carrier is a decelerating movement under influence of gravity caused by the movement of the guideway.

18. The method according to claim 17, wherein the decelerating movement occurs during an upward movement of part of the guideway.

19. The method for use of the device according to claim 13, wherein the passenger moves along a part of the guideway in the direction toward the swivel axis while the swivel axis is located lower than the passenger car.

* * * * *